United States Patent [19]

Nomi

[11] 4,368,766

[45] Jan. 18, 1983

[54] SELF-COOLING WATER CONTAINER

[75] Inventor: Haruo Nomi, Okayama, Japan

[73] Assignee: Junkosha Company, Ltd., Tokyo, Japan

[21] Appl. No.: 220,171

[22] Filed: Dec. 23, 1980

[30] Foreign Application Priority Data

Dec. 24, 1979 [JP] Japan ..... 54-179005[U]

[51] Int. Cl.[3] ..... B65D 30/02

[52] U.S. Cl. ..... 150/1

[58] Field of Search ..... 150/8, 2.1, 1; 128/DIG. 14; 138/DIG. 3; 206/439, 819; 222/146 C; 62/315, 316, 457; 264/235.6

[56] References Cited

U.S. PATENT DOCUMENTS

| | | | |
|---|---|---|---|
| 2,467,792 | 4/1949 | Wenzel et al. | 150/1 |
| 3,082,611 | 3/1963 | Alvis et al. | 206/819 X |
| 3,367,380 | 2/1968 | Dickey | 150/1 |
| 3,953,566 | 4/1976 | Gore | 264/235.6 X |
| 4,063,383 | 12/1977 | Green | 206/439 X |
| 4,132,594 | 1/1979 | Bank et al. | 150/1 |

OTHER PUBLICATIONS

"Expanded Teflon TFE Opens New Range of Applications", The Journal of Teflon, Oct./Nov. 1971.

*Primary Examiner*—William Price
*Assistant Examiner*—Sue A. Weaver
*Attorney, Agent, or Firm*—Mortenson & Uebler

[57] ABSTRACT

A self-cooling water container is provided capable of keeping the temperature of the contained water lower than the ambient temperature by utilizing the heat of water vaporization. The disclosed water container is comprised of a water repellant, continuously porous resin material or a gas permeable laminate including the porous material as a major ply element.

3 Claims, 5 Drawing Figures

SELF-COOLING WATER CONTAINER

BACKGROUND OF THE INVENTION

This invention relates to a self-cooling water container capable of keeping the temperature of the contained water lower than the ambient temperature by utilizing the heat of water vaporization In dry, hot regions such as the Arabian peninsula, water is supplied for drinking purposes after storing it in a porous ceramic pot or a canteen made of leather or cloth. The stored water is cooled lower than the ambient temperature by utilizing the self-cooling ability of the container. When water is stored in such a container, the water soaks the wall and gradually exudes out to the outer surface of the container. The exuded water is then vaporized taking the heat, through the vaporization process, from the contained water to reduce the stored water temperature to a point lower than the outside temperature.

These conventional self-cooling water containers have many disadvantages. The porous pot is fragile and the outer surface is always wet due to the oozed water. The porous pot as well as the leather and cloth containers become heavy when filled with water, hence, inconvenient to carry. Further, the loss of water due to oozing is fairly large. Impurities in material and dirt (including microbes) adhered to the outside of such containers are dissolved in the exuded water and are transferred back to the interior water, thus giving smells to the water and polluting the water, presenting hygienic problems.

The purpose of the present invention is to provide a self-cooling water container utilizing the heat of vaporization to reduce the interior water temperature to a point lower than the exterior temperature, while overcoming many disadvantages of conventional water containers. The following specific advantages are achieved by this invention:

1. The outside surface of the container remains dry.
2. There is no loss of water due to exudation.
3. No smells or pollution of the inside water occur because no contaminants adhere to the outside contact surface, dissolve or transfer into the inside water across the container wall. Rather, oxygen in the atmosphere easily transfers through the container wall and dissolves into the inside water, hence keeping the water from being putrefied.
4. The container is resistant to tearing and ripping, lightweight, non water-absorbent, flexible so that it can be folded compactly, and convenient to carry due to the dry outside surface.
5. The container, if necessary, can be maintained in a specified, three-dimensional shape by using a perforated backing material such as metal net, punched metal sheet, etc.
6. The preferred interior surface is a smooth, water repellent, continuously porous material and will not allow any adhesion of contaminants, while at the same time allowing for perfect cleaning and sterilization.

SUMMARY OF THE INVENTION

The water container of the present invention is comprised of a water repellent, continuously porous material, or a gas permeable laminate including said porous material as a major ply element.

The resin to be used to produce the water repellent, continuously porous material includes various fluorocarbon resins (most preferably polytetrafluoroethylene), polyester, polyethylene, etc. These resins are made into a porous structure having maximum pore size in the range of 0.1–50 microns by conventional methods.

Figure 1:
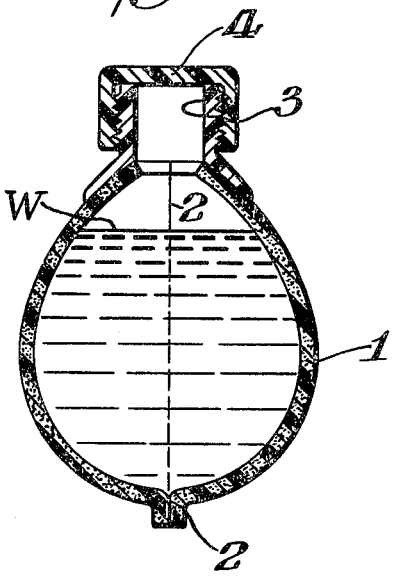
FIG. 1 is a cross sectional view of an example of a water container embodying the present invention.

DETAILED DESCRIPTION OF THE INVENTION AND PREFERED EMBODIMENTS WITH REFERENCE TO THE DRAWINGS

In the drawings, numeral 1 indicates the water-repellent, continuously porous resin material; numeral 2 indicates the place of bonding; numeral 3 is the mouth of the container; numeral 4 is the cap; and numeral 5 is the gas permeable layer laminated to the porous material.

FIG. 1 shows an embodiment of the present invention in which two pieces of water repellent, continuously porous resin sheets 1 are water-tightly bonded together around the periphery 2 by adhesion, fusion bonding or sewing to form a water containing bag. The mouth 3 of the bag is attached by adhesion or fusion bonding, and the cap 4 screws onto the mouth 3.

Figure 2:
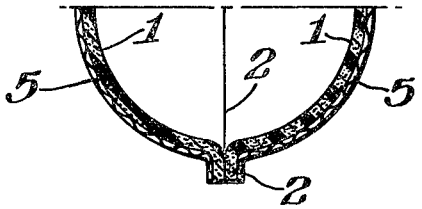
FIG. 2 through 4 show portions of the cross sections of three water containers of the present invention, each made using a laminate of different construction.

FIG. 2 shows another embodiment of the present invention in which a laminate of said porous material 1 and a gas permeable material 5 (e.g. synthetic cloth) is used as sheet material for reinforcement and decoration, with the material 5 on the outside.

Figure 3:
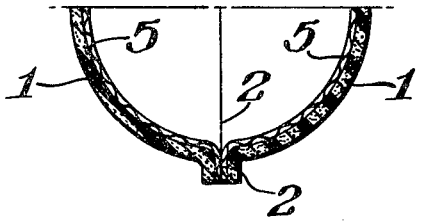

FIG. 3 is still another embodiment of the present invention in which the laminate of FIG. 2 is used with the material 5 being located on the inside of the container.

Figure 4:
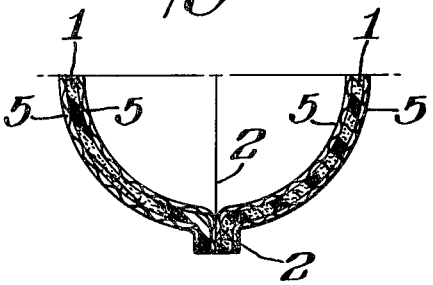

FIG. 4 is still another example in which a three layered laminate having the gas permeable material 5 on both the front and back surface of the porous material is used.

Figure 5:
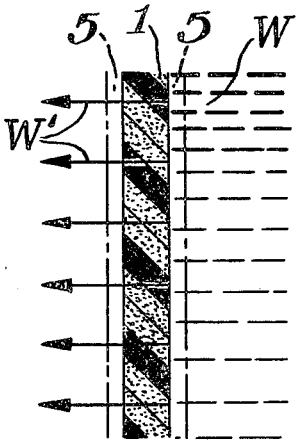
FIG. 5 is a schematic sectional view of the container wall and serves to explain the vaporization process.

Referring to FIG. 5, a explanation of the effectiveness of the water container of the present invention is as follows: Since the container layer I is made of the water repellent, continuously porous material, the water W in the container does not soak into the wall 1 and ooze through to the outside as in containers made of unglazed pottery, leather and cloth. The contained water W vaporizes on the contact surface between the porous wall 1 and the water W, or on the contact surface between the porous wall 1 and the gas permeable layer 5 which is in direct contact with the water. The water vapor W′ easily passes through the continuous fine pores in the porous wall 1 and the gas permeable layer 5 to the outside if the gas permeable layer 5 is laminated to the porous wall 1. The higher the porosity of the wall 1, the more active is the vaporization at said surface. The heat utilized in the process of water vaporization on the surface absorbs the heat contained in the water W inside the container. Thus, the water temperature inside the container is kept lower than the ambient temperature.

The water container of the present invention is made of the water repellent, continuously porous, resin material mentioned above, or of a gas permeable laminate including said material as a primary layer. The laminate is obtained by laminating gas permeable fabric(s) onto the front and/or back surface(s), for the purpose of reinforcement and decoration, in a manner so as not to lower the gas permeability (i.e. lamination via powdered, dotted or patterned adhesion or fusion). Metal net or a punched metal sheet may be included between the porous material or as a member of the laminate for the purpose of reinforcement or support so as to keep the shape of the container. Expanded, porous polytetrafluoroethylene (EPTFE) having continuous, fine pores, produced by the method stated in Japanese Patent Publication JPP No. Sho 51-18991, is preferred. By this method, lubricated PTFE (a mixture of PTFE fine powder with a liquid lubricant, e.g., solvent naphtha, whiteoil, etc., in the weight ratio of ca. 80:20) is formed by ram-extrusion and/or rolling into a shaped article (with ≧ 95% crystallinity) into a sheet or tube, the liquid lubricant is removed from the shaped article by extraction or evaporation (heating above the boiling point of the liquid lubricant), and the shaped article is stretched in at least one direction at a temperature below 327° C. at a stretching rate of 10%/sec. or faster. By this process, a continuously porous PTFE shaped article, having a micro structure of nodes interconnected by fibrils with innumerable fine pores between the nodes and fibrils, is obtained. The EPTFE thus obtained may be used as an unsintered product when subjected to a heat setting below 327° C. or as a sintered product when subjected to heating above 327° C.

By changing the stretching direction, ratio, rate, temperature, heat-set or sintering conditions the physical properties of the expanded porous PTFE can be optionally varied in a wide range as follows:

Porosity: 40–95%

Maximum pore size: 0.1–50 microns, preferably less than 5

Specific gravity: 0.15–1 g/cm$^3$

Gurley number: 0.1–100 seconds

Ethanol bubble point: 0.2–3 kg/cm$^2$

Matrix tensile strength: 514 kg/cm$^2$ or more

Thickness: 0.01 mm or more

The EPTFE is very flexible and has excellent surface smoothness, water repellency (water permeability: 0–1 cm$^3$/min.dm$^2$. /mag, and heat and chemical resistance, etc.)

Another method of forming the water container of this invention may be by drawing or shaping the porous, water repellent material into the desired form under application of heat and pressure.

The following examples are provided for illustration purposes only and should not be deemed to limit the scope of this invention in any way.

EXAMPLE 1

A commercial laminate, trademarked Gore-Tex® fabric (which is made of a continuously porous PTFE film 1 and two sheets of nylon taffeta 5 laminated to both faces of said film), was cut into two pieces of the desired shape. These pieces were overlapped together, and the nylon taffetas on the periphery of the overlapped pieces were bonded together water-tightly as shown in FIG. 4, where numeral 2 indicates the bonded portion around the periphery, by using a high-frequency welder, thus producing a water container.

The water container so produced was filled with ca. 0.7 liters of water, and hung in the shade outdoors on a fine, summer day. For purposes of comparison, a commercially available aluminum canteen was filled with water and was conditioned outdoors, simultaneously with the container of the present invention. Water temperatures in the containers. were measured after one hour, and the results are listed below:

| Atmospheric temp. (°C.) | Water temp. (°C.) in the container of the present invention | Water temp. (°C.) in the aluminum canteen |
|---|---|---|
| 27.0 | 21.0 | 26.0 |
| 28.0 | 22.0 | 28.0 |
| 28.5 | 21.5 | 28.0 |

EXAMPLE 2

A water container was produced by using the same material and process as in Example 1 with the exception that a polyester based adhesive was used in the bonding process instead of the high frequency welder. The container filled with water was hung in a room for an hour, and the water temperature was measured. For purposes of comparison, a wet-bulb thermometer and an aluminum canteen filled with water were also put beside the container, and the water temperatures of these were measured. The measurement results were as follows:

| Dry bulb temp. (°C.) | Wet bulb temp. (°C.) | Water temp. (°C.) in the container | Water temp. (°C.) in the canteen |
|---|---|---|---|
| 26 | 20.5 | 21 | 26 |
| 28 | 21.5 | 21.5 | 27.5 |

During the above experiments, the outer surface of the water container of the present invention remained dry, and there was no water leakage from the bonded seam.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An improved self-cooling water container having a mouth and a removable cap attached to a porous bag in which said water is contained, wherein the improvement comprises said bag made of a water repellent, water vapor permeable porous resin material having continuous pores, the maximum pore size being in the range of 0.1 to 50 microns, and ethanol bubble point in the range of about 0.2 to about 3.0 kg/cm$^2$.

2. The water container of claim 1 wherein said bag is a laminate in which one layer is said water repellent, porous material.

3. The water container of claim 1 wherein said water repellent, porous material is expanded polytetrafluoroethylene.

* * * * *